US007458309B2

(12) United States Patent
Simmons et al.

(10) Patent No.: US 7,458,309 B2
(45) Date of Patent: Dec. 2, 2008

(54) RECIPROCATING PUMP, SYSTEM OR RECIPROCATING PUMPS, AND METHOD OF DRIVING RECIPROCATING PUMPS

(76) Inventors: Tom M. Simmons, 3670 Raucholz Rd., Hemlock, MI (US) 48626; John M. Simmons, 1077 Watson Rd., Hemlock, MI (US) 48626; David M. Simmons, 8873 N. Brookshire Dr., Saginaw, MI (US) 48609

( * ) Notice: Subject to any disclaimer, the term of this patent is extended or adjusted under 35 U.S.C. 154(b) by 164 days.

(21) Appl. No.: 11/437,447

(22) Filed: May 18, 2006

(65) Prior Publication Data

US 2007/0266846 A1 Nov. 22, 2007

(51) Int. Cl.
*F04B 43/073* (2006.01)
*F04B 43/067* (2006.01)

(52) U.S. Cl. ..... 91/230; 417/393

(58) Field of Classification Search ..... 91/230, 91/297, 275; 417/393, 397, 473
See application file for complete search history.

(56) References Cited

U.S. PATENT DOCUMENTS

| | | | | |
|---|---|---|---|---|
| 1,161,787 | A | 11/1915 | Nickol | |
| 2,239,727 | A | 4/1941 | Mayer | |
| 2,467,413 | A | 4/1949 | Wildhack | |
| 3,081,794 | A | 3/1963 | Lucien | |
| 3,362,618 | A | 1/1968 | Fortinov | |
| 3,741,689 | A | 6/1973 | Rupp | |
| 3,749,127 | A | 7/1973 | Beeken et al. | |
| 3,773,083 | A | 11/1973 | Hague et al. | |
| 3,791,768 | A | 2/1974 | Wanner | |
| 3,838,946 | A | 10/1974 | Schall | |
| 4,203,571 | A | 5/1980 | Ruchser | |
| 4,325,127 | A * | 4/1982 | Major | 91/275 |
| 4,386,888 | A | 6/1983 | Verley | |
| 4,496,294 | A | 1/1985 | Frikker | |
| 4,548,551 | A | 10/1985 | Ruttenberg et al. | |
| 4,566,867 | A | 1/1986 | Bazan et al. | |
| 4,634,350 | A | 1/1987 | Credle, Jr. | |
| 4,655,378 | A | 4/1987 | DuFour | |

(Continued)

FOREIGN PATENT DOCUMENTS

| | | |
|---|---|---|
| DE | 3942981 | 7/1991 |

(Continued)

OTHER PUBLICATIONS

International Search Report for International Application No. PCT/US2007/011475, dated Oct. 31, 2007 (4 pages).

*Primary Examiner*—Thomas E Lazo
(74) *Attorney, Agent, or Firm*—TraskBritt

(57) ABSTRACT

Reciprocating pumps are disclosed. Particularly, reciprocating pumps including pressure chambers and fluid chambers defined by flexible members are disclosed. The volume of the pressure chambers and fluid chamber may be controlled using a piston driven by the flow of a control fluid to a pressure chamber and associated piston chamber. The flow of the control fluid may be directed to a first pressure chamber and associated piston chamber or a second pressure chamber and associated piston chamber. A pneumatically driven switch or an electrically driven switch may direct the flow of control fluid. The electrically driven switch may be controlled with a timer, a pressure sensor, or an optical sensor. The reciprocating pump requires minimal modification to permit the use of a pneumatic switch or electrical switch.

31 Claims, 12 Drawing Sheets

U.S. PATENT DOCUMENTS 4,701,615 A * 10/1987 Schmitt ..... 250/237 G
4,736,773 A 4/1988 Perry et al.
4,836,756 A 6/1989 Fukumoto
4,902,206 A 2/1990 Nakazawa et al.
4,927,335 A 5/1990 Pensa
4,981,418 A * 1/1991 Kingsford et al. ..... 417/63
4,983,104 A 1/1991 Kingsford et al.
5,060,694 A 10/1991 Florida et al.
5,174,731 A 12/1992 Korver
5,222,521 A 6/1993 Kihlberg
5,224,841 A 7/1993 Thompson et al.
5,232,352 A 8/1993 Robinson
5,238,372 A 8/1993 Morris
5,252,042 A 10/1993 Yonezawa
5,277,555 A 1/1994 Robinson
5,326,234 A 7/1994 Versaw et al.
5,484,269 A 1/1996 Vick
5,551,847 A 9/1996 Gardner et al.
5,558,506 A * 9/1996 Simmons et al. ..... 417/393
5,649,813 A 7/1997 Able et al.
5,707,217 A 1/1998 Loeffler
5,893,707 A * 4/1999 Simmons et al. ..... 91/230
5,927,954 A 7/1999 Kennedy et al.
6,004,105 A 12/1999 Reynolds
6,079,959 A 6/2000 Kingsford et al.
6,454,542 B1 * 9/2002 Back ..... 91/275
6,685,443 B2 2/2004 Simmons et al.
6,814,553 B2 * 11/2004 Watanabe et al. ..... 417/473
6,834,574 B2 * 12/2004 Neumann ..... 91/1
6,874,997 B2 * 4/2005 Watanabe et al. ..... 91/297
6,921,253 B2 7/2005 Shuler et al.
6,957,952 B1 10/2005 Steck et al.
7,178,446 B2 * 2/2007 Kucher et al. ..... 91/1
2003/0131724 A1 7/2003 Neumann

FOREIGN PATENT DOCUMENTS

DE 19535745 3/1997
EP 0410394 1/1991

* cited by examiner

RECIPROCATING PUMP, SYSTEM OR RECIPROCATING PUMPS, AND METHOD OF DRIVING RECIPROCATING PUMPS

BACKGROUND OF THE INVENTION

1. Field of the Invention

The present invention relates generally to a reciprocating pump which may be pneumatically or electronically shifted.

2. State of the Art

Numerous industries and many applications utilize reciprocating pumps, particularly in the fluid industry. Reciprocating fluid pumps may include two fluid chambers. Each fluid chamber may include an associated pumping means, such as a piston, bellows, or diaphragm, which may be driven such that when one fluid chamber is being compressed to expel fluid, the other fluid chamber is expanded to receive fluid. The pumping means may include two pressure chambers, which alternate being filled with pressurized air and exhausting pressurized air. A reciprocating spool valve may operate the pumping means, shifting the pressurized air flow from one pressure chamber to the other as the pumping means reaches the end of a pumping stroke. A valve spool element in the spool valve may shift between two positions. The first position may supply pressurized air to the pressure chamber of one side of the pump while simultaneously exhausting the air from the pressure chamber on the other side of the pump. The shifting of the valve spool element simply alternates this pressurized air/exhaust between pressure chambers, driving the pumping means, thereby creating the reciprocating pumping action of the pump.

The valve spool element may be shifted mechanically, electronically, or pneumatically. A conventional, mechanically shifted reciprocating pump is described in U.S. Pat. No. 4,902,206 to Nakazawa et al. A system of rods and actuating means may drive the spool valve element to the opposite position each time the pumping means reaches the end of its pumping stroke, causing a new pumping stroke to begin. Pressurized air is thus supplied to alternating pressure chambers.

A conventional electronically actuated switching valve is described in U.S. Pat. No. 4,736,773 to Perry et al. An electronically actuated solenoid exhaust valve including pressure pilots on either side of a valve spool may be operable to cause a pressure drop in one pressure pilot on one side of the valve spool, causing the valve spool to change position.

A conventional pump which uses solenoids to regulate the supply of pressurized air between pressure chambers is described in U.S. Pat. No. 6,079,959 to Kingsford et al. Pressurized air may be injected into a pressure chamber, or the supply of pressurized air to a pressure chamber may be terminated when a fiber optic sensor senses the desired travel of a piston driving the pressure chamber.

A conventional pump having a pneumatically activated switching mechanism is described in U.S. Pat. No. 6,874,997 to Wantanabe et al. The switching mechanism of Wantanabe includes a rod having a bore formed in the axial direction extending from the base end to the tip. The bore has a top portion communicating with holes formed in the sidewalls. The holes in the sidewalls communicate with holes in a cylindrical case housing the rod when the rod is positioned in certain locations within the cylindrical case, namely near the end of a pump stroke. Pilot air or control fluid may pass through the bore within the rod, through the holes in the sidewall of the rod and the holes in the cylindrical case, and travel to a valve spool, causing the valve spool to change position, thereby switching the flow of pressurized air from one pressure chamber to the other. However, the bore and hole within the rod are difficult and expensive to manufacture, and lower the strength of the rod.

It may be desirable in some instances to use a pneumatic or mechanically actuated switching mechanism, while an electronically activated switching mechanism may be desirable in other applications. For example, electrical switching of the spool valve may be prohibited in some situations because of the potential for spark and fire hazards generally associated with electric (i.e., spark generating) switching devices.

A pump manufacturer may need to carry numerous parts to supply pneumatic, mechanical, and electronically controlled reciprocating pumps in order to meet the needs of different customers. Therefore, it would be advantageous to provide a pump system which requires only slight modification to be driven electronically or pneumatically.

BRIEF SUMMARY OF THE INVENTION

One embodiment of the present invention provides a reciprocating pump having a first pressure chamber at least partially defined by a first flexible member and a second pressure chamber opposing the first pressure chamber at least partially defined by a second flexible member. A first shift piston may drive the first flexible member. The first shift piston may comprise an elongated member including a first end portion having a first cross-sectional area and a central portion having a second cross-sectional area greater than the first cross-sectional area.

In addition, a second shift piston may be included for driving the second flexible member. The second shift piston may comprise an elongated member including a first end portion having a first cross-sectional area and a central portion having a second cross-sectional area greater than the first cross-sectional area. A connecting member may effect reciprocating movement of the first flexible member and the second flexible member as the first pressure chamber and the second pressure chamber are alternately filled with control fluid. The supply of control fluid may be shifted from the first pressure chamber to the second pressure chamber with a pneumatically shifted spool valve. Alternatively, the spool valve may be electronically shifted. The electronic shifting may be actuated using a signal from an optical sensor. The shift piston may include a first portion bordered with contrasting color portions for sensing by the optical sensor. In other embodiments of the present invention, the electronic shifting may be actuated using a pressure sensor or a timer.

In another aspect of the present invention, a method of driving a reciprocating pump includes providing a housing having a first pressure chamber and a second pressure chamber disposed therein, wherein the first pressure chamber is at least partially defined by a first flexible member and the second pressure chamber is at least partially defined by a second flexible member. The first pressure chamber may be filled with a control fluid, thus increasing the volume of the first pressure chamber. A first piston chamber may be filled with the control fluid, thus pressing a first shift piston at least partially housed within the first piston chamber against the first flexible member. Displacing the first shift piston creates a shift conduit between an outside surface of the first shift piston and an inside surface of the first piston chamber. A first shift line in communication with the shift conduit and the first piston chamber may be filled with the control fluid. Displacing the first shift piston eliminates communication between the first piston chamber and the first shift line.

Displacing the first shift piston may be toward the first flexible member, and at least a portion of the first flexible member may be simultaneously displaced. Control fluid may be expelled from the second pressure chamber while simultaneously filling the first pressure chamber with the control fluid. Shifting a shuttle valve with a force generated by the flow of the control fluid from the first shift line will switch the flow of control fluid from the first pressure chamber to the second pressure chamber. Optionally, a pressure switch in communication with the first shift line may be signaled when the first shift line fills with control fluid. The flow of control fluid between the first pressure chamber and the second pressure chamber may be controlled with the pressure switch. In another embodiment, the displacement of the first shift piston may be optically sensed with an optical sensor, and the flow of control fluid between the first pressure chamber and the second pressure chamber may be controlled with a control switch in communication with the optical sensor.

Another embodiment of a reciprocating pump may include a body defining a first fluid chamber and a first pressure chamber separated with a first flexible member and a second fluid chamber and a second pressure chamber separated with a second flexible member. A shaft may connect the first flexible member and the second flexible member. A switching mechanism may alternately supply control fluid to the first pressure chamber and the second pressure chamber, the first flexible member and the second flexible member displacing with the supplied control fluid. A first shift piston configured for displacement with the first flexible member may be driven by the supplied control fluid. The first shift piston may comprise an elongated member including a first end portion having a first cross-sectional area and a central portion having a second cross-sectional area greater than the first cross-sectional area. Likewise, a second shift piston may be configured for displacement with the second flexible member, driven by the supplied control fluid. The second shift piston may comprise an elongated member including a first end portion having a first cross-sectional area and a central portion having a second cross-sectional area greater than the first cross-sectional area. A first shift line may be in communication with the supplied control fluid when the first end portion of the first shift piston is adjacent thereto and isolated from the supplied control fluid when the central portion of the first shift piston is adjacent thereto. A second shift line may be in communication with the supplied control fluid when the first end portion of the second shift piston is adjacent thereto and isolated from the supplied control fluid when the central portion of the second shift piston is adjacent thereto.

The switching mechanism of the reciprocating pump may be actuated by the supplied control fluid in the first shift line and the second shift line. Alternatively, the switching mechanism of the reciprocating pump may be actuated by a pressure sensor configured to detect the supplied control fluid in the first shift line and the second shift line. In yet another alternative, the switching mechanism may be actuated by an optical sensor configured to detect a first position and a second position of the first shift piston. Optionally, the switching mechanism may be actuated by an optical sensor configured to detect a first position of the first shift piston and a first position of the second shift piston, or with a timer.

In yet another aspect of the present invention, a system of reciprocating pumps may comprise a control pump having a reciprocating shift piston with at least three bands of contrasting colors, an optical sensor configured to detect at least a first position, a second position, and a third position of the reciprocating shift piston, a shifting system in communication with the optical sensor, the shifting system configured to shift the supply of a control fluid from a first side of the control pump to a second side of the control pump, and a second pump controllable by the shifting system, the control fluid being alternately supplied to a first side of the second pump and a second side of the second pump from the shifting system.

Other features and advantages of the present invention will become apparent to those of skill in the art through consideration of the ensuing description, the accompanying drawings, and the appended claims.

BRIEF DESCRIPTION OF THE SEVERAL VIEWS OF THE DRAWINGS

The foregoing and other advantages of the present invention will become apparent upon review of the following detailed description and drawings in which:

FIG. 11 shows a cross-sectional view of a reciprocating pump according to the present invention with a shuttle valve built in;

DETAILED DESCRIPTION OF THE INVENTION

The shift piston according to the present invention may be used in a variety of reciprocating pump applications. The shift piston may be used with a pneumatically actuated spool valve or an electronically actuated spool valve controlled using fiber optics, pressure sensors, or a timer. Reciprocating pumps having mechanisms other than a spool valve, also known as a shuttle valve, for switching the flow of control fluid from one pressure chamber to another are also within the scope of the present invention. The shift piston may also be used in a reciprocating pump having stroke monitoring capabilities.

Figure 1:
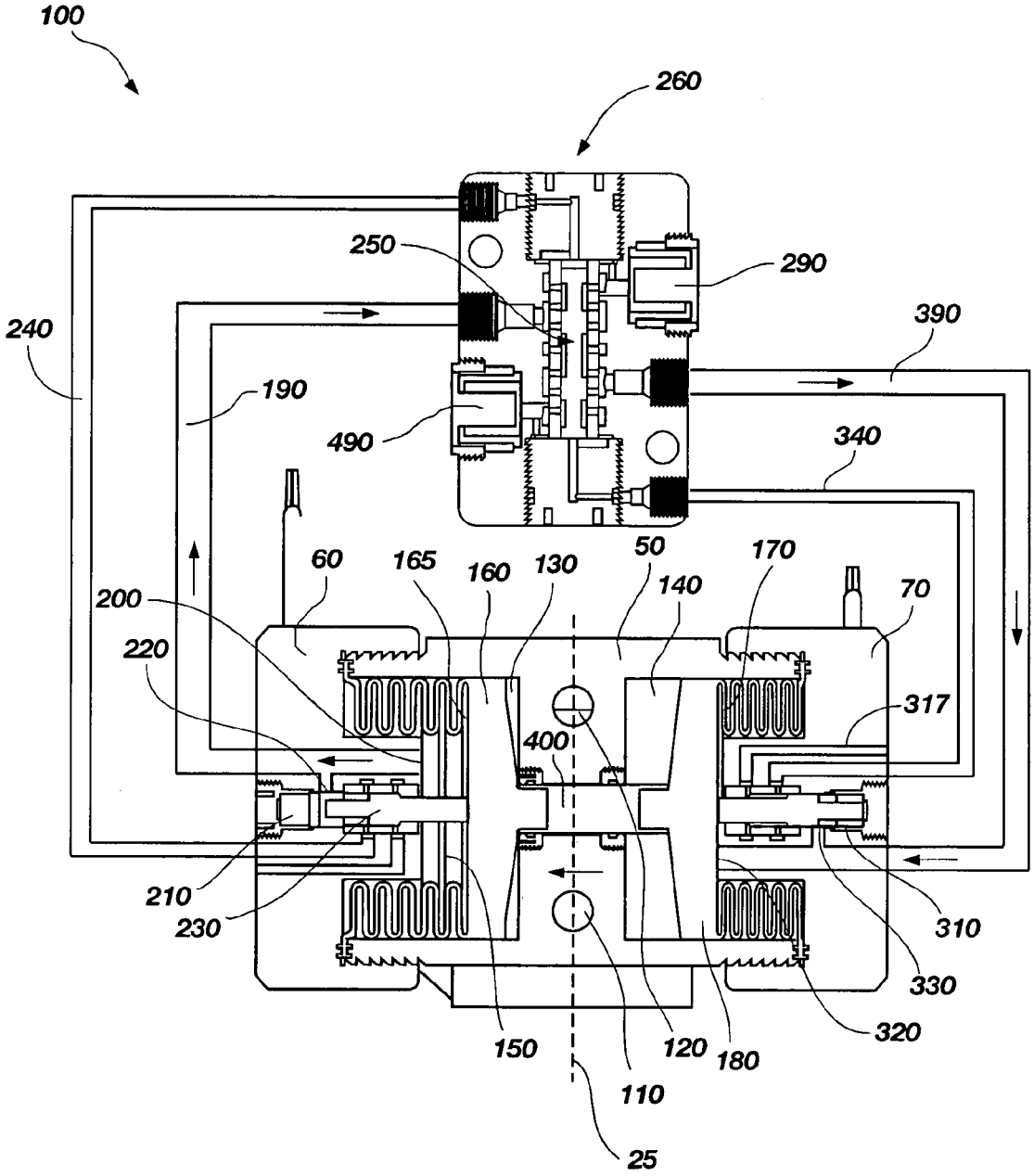
FIG. 1 shows a pneumatically actuated reciprocating pump according to the present invention.

A first embodiment of reciprocating pump 100 including a shift piston according to the present invention is depicted in FIG. 1. The pump 100 is generally symmetrically configured along a line 25 extending through the midpoint of a housing 50 thereof. The reciprocating pump 100 includes a fluid inlet port 110 and a fluid outlet port 120. The fluid inlet port 110 and fluid outlet port 120 may be in communication with a first fluid chamber 130 and a second fluid chamber 140. At the start position depicted in FIG. 1, fluid may be drawn into the first fluid chamber 130 through the fluid inlet port 110 and expelled from the second fluid chamber 140 through the fluid outlet port 120. The fluid inlet and outlet ports may be operable by one-way valves, also known as check valves. One suitable example of a check valve is a ball valve, which may prevent mixing of the fluid being drawn into the reciprocating pump 100 and the fluid being expelled from the reciprocating pump 100.

The volume of the first fluid chamber 130 may be controlled by a first flexible member 160. The first flexible member 160 may comprise, for example a diaphragm or a bellows which forms a first pressure chamber 150. The term "flexible member" applies to members constructed entirely of flexible material, as well as members having rigid portions as well as flexible portions, such as the bellows depicted in FIG. 1. Any member or combination of members capable of forming an expandable and contractable chamber is within the scope of the present invention.

Figure 2:
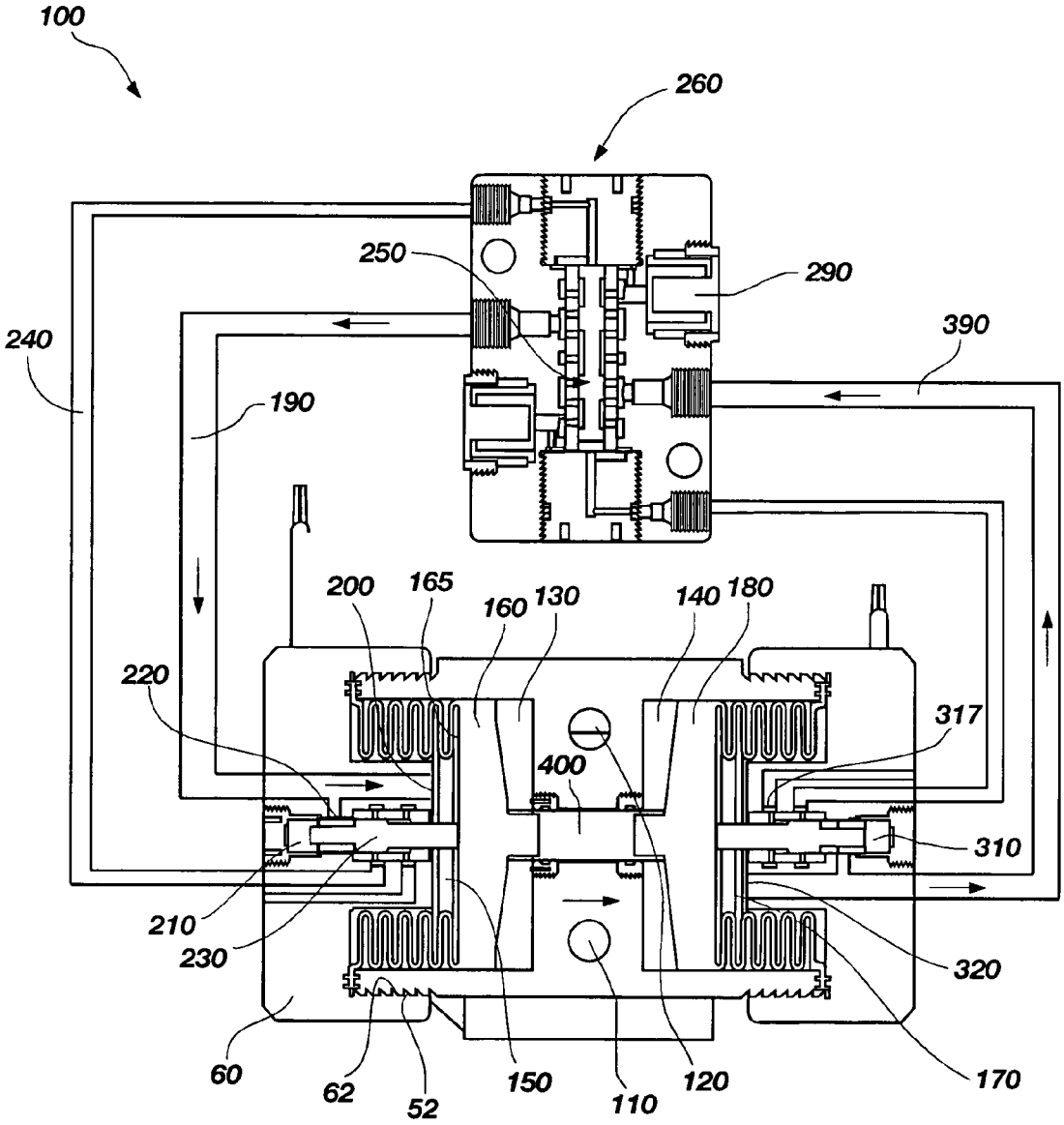
FIG. 2 shows the pneumatically actuated reciprocating pump of FIG. 1 in another phase of a pump cycle.

A flow of a control fluid, for example pressurized air, into the first pressure chamber 150 as shown in FIG. 2 may cause the first pressure chamber 150 to expand, and the first flexible member 160 to move rightward, reducing the volume of the first fluid chamber 130 and forcing the fluid out the fluid outlet port 120. Likewise, a second flexible member 180 forming a second pressure chamber 170 may control the volume of a second fluid chamber 140. The first flexible member 160 and the second flexible member 180 may be fixed relative to one another with a shaft 400. As the first flexible member 160 is forced rightward by the flow of control fluid into the first pressure chamber 150, the second flexible member 180 may be pushed rightward by the shaft 400. The volume of the second fluid chamber 140 may increase, and the volume of the second pressure chamber 170 may decrease. Thus, fluid may be drawn into the second fluid chamber 140 through the fluid inlet port 110.

FIG. 1 depicts the pump 100 in a start position for a return stroke. Return is used for clarity in the description; however, it will be understood that the reciprocating pump may begin operation at any phase of any stroke. In a return stroke, fluid may be discharged from the second fluid chamber 140 through the fluid outlet port 120 and drawn into the first fluid chamber 130 through the fluid inlet port 110. A flow of control fluid into the second pressure chamber 170 may cause the second pressure chamber 170 to expand, and the second flexible member 180 to move leftward, reducing the volume of the second fluid chamber 140 and forcing the fluid out of the fluid outlet port 120. As the second flexible member 180 is forced leftward by the flow of control fluid into the second pressure chamber 170, the first flexible member 160 may be pushed leftward by the shaft 400. The volume of the first fluid chamber 130 may increase, and the volume of the first pressure chamber 150 may decrease. Thus, fluid may be drawn into the first fluid chamber 130 through the fluid inlet port 110.

In operation, the volume of the first pressure chamber 150 may be increased by control fluid entering from a first supply line 190 through a first primary supply port 200 as shown in FIG. 2. Control fluid from the first supply line 190 may also enter a first piston chamber 210 through a first secondary supply port 220. The control fluid within the first piston chamber 210 may force a first shift piston 230 against a surface 165 of the first flexible member 160 facing the first pressure chamber 150. Control fluid entering the first pressure chamber 150 and the first piston chamber 210 forces the first shift piston 230 and the first flexible member 160 to displace to the right, increasing the volume of the first pressure chamber 150 and decreasing the volume of the first fluid chamber 130.

The first flexible member 160 and the second flexible member 180 may be fixed relative to one another with a shaft 400. The first flexible member 160 and the second flexible member 180 may be attached to the shaft 400, such that both a pushing and a pulling force on either flexible member may be translated through the shaft 400. Alternatively, the first flexible member 160 and the second flexible member 180 may merely abut the ends of the shaft 400, such that a pushing force may be translated from one flexible member to the other via the shaft 400. Thus, the first and second flexible members 160, 180 may be easily removed if the respective first or second housing end portion 60, 70 is removed. As the first flexible member 160 is forced rightward by the control fluid, the shaft 400 is displaced rightward, and the second flexible member 180 is pushed rightward by the shaft 400. The volume of the second fluid chamber 140 increases, and the volume of the second pressure chamber 170 decreases. Control fluid within the second pressure chamber 170 is forced out of a second primary supply port 320.

At the end of a stroke, the control fluid must feed into the pressure chamber of the other side of the pump in order to initiate the next stroke. A spool valve 260 may shift the supply of control fluid from the first supply line 190 to the second supply line 390. The spool valve 260 includes a shuttle spool 250 therein. The position of the shuttle spool 250, and thus the supply of control fluid, may be shifted by a blast of control fluid or other methods such as electronic actuation.

Figure 3:
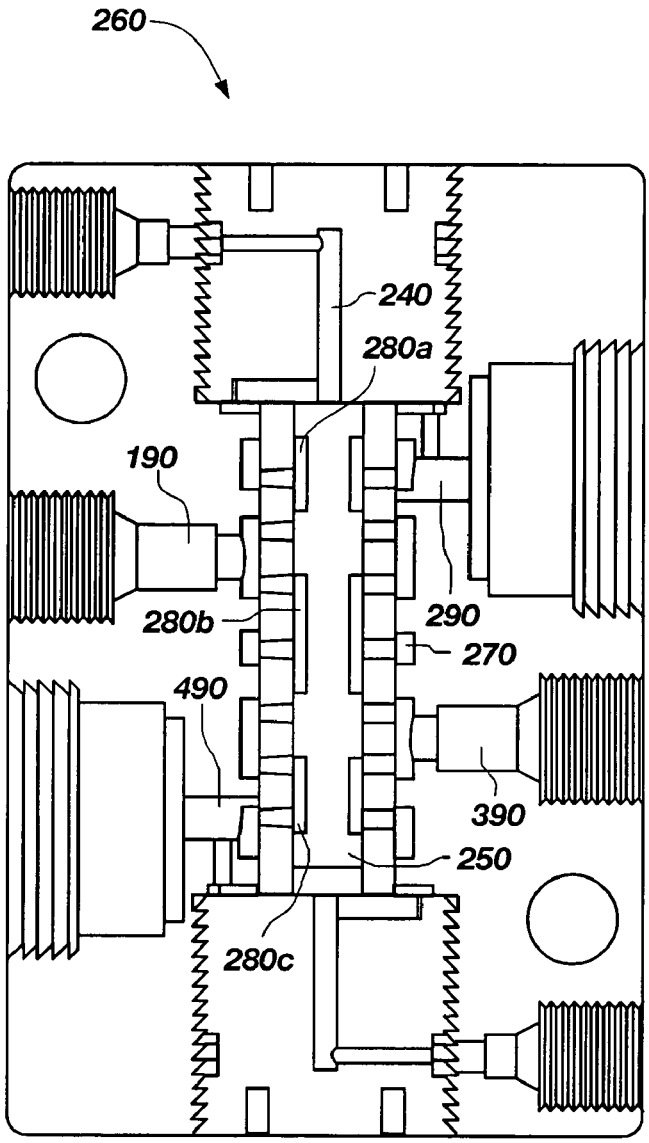
FIG. 3 shows a shift valve of the present invention in the phase of the pump cycle of FIG. 2.

FIG. 3 depicts a close-up view of the spool valve 260 in a first position, the first position being the position of the phase of operation depicted in FIG. 2. Control fluid may be supplied to the first supply line 190, and the second supply line 390 may be in communication with a second exhaust port 490. Control fluid may be provided by a control fluid source, such as a pressurized air source (not shown) through air supply port 270. The air supply port 270 may communicate with the first supply line 190 through a conduit 280*b* in the spool valve 260. The spool valve 260 includes three conduits 280*a*, 280*b*, 280*c*. Each conduit may comprise a gap positioned between an inner wall of the shuttle valve housing and a portion of the substantially cylindrical shuttle spool 250 with a lesser cross-sectional area. With the shuttle spool 250 in the first position, the first conduit 280*a* may be in communication with a first exhaust line 290. The second conduit 280*b* may provide communication between the air supply port 270 and the first supply line 190. The third conduit 280*c* may provide communication between the second supply line 390 and a second exhaust port 490. Thus, referring back to FIG. 2, the control fluid may be supplied through the first supply line 190 to fill the first pressure chamber 150. Simultaneously, air may be exhausted from the second pressure chamber 170 through the second supply line 390 to the second exhaust port 490.

Figure 4:
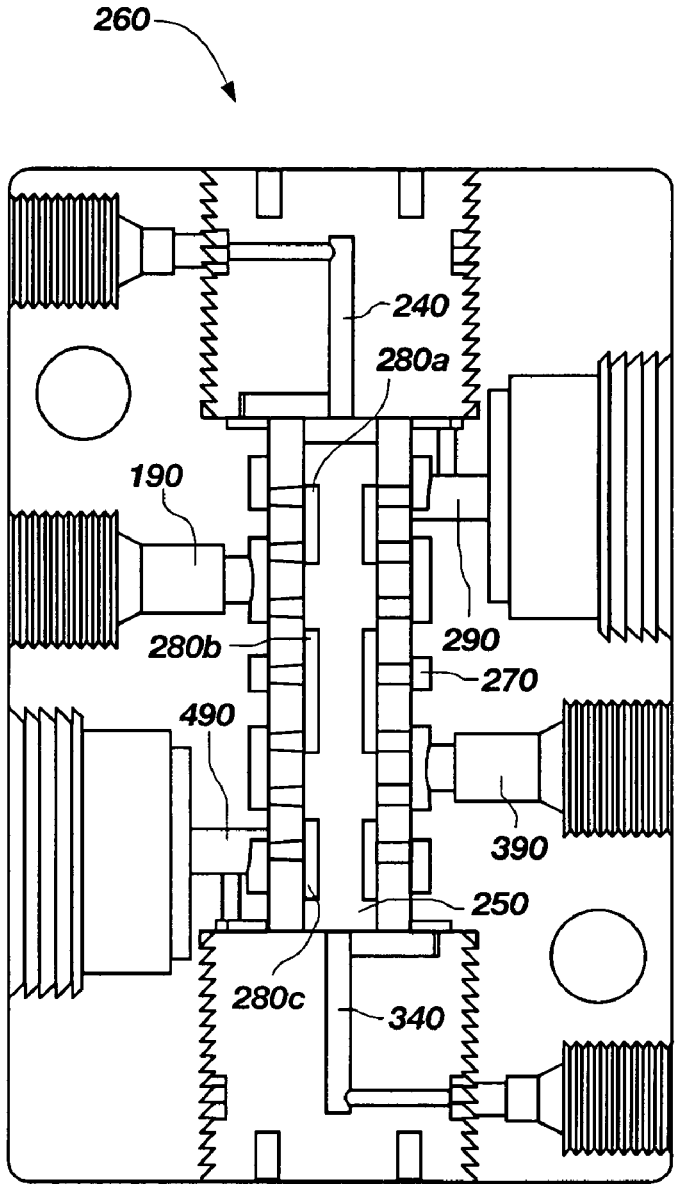
FIG. 4 shows the shift valve of FIG. 3 in the phase of a pump cycle of FIG. 1.

With the shuttle spool 250 in a second position, as shown in FIG. 4, the first conduit 280*a* provides communication between the first supply line 190 and the first exhaust line 290. The second conduit 280*b* provides communication between the between the air supply port 270 and the second supply line 390. The third conduit 280*c* may communicate only with the second exhaust port 490. Thus, referring back to FIG. 1, control fluid may be supplied through the second supply line 390 to fill the second pressure chamber 170. Simultaneously, air may be exhausted from the first pressure chamber 150 through the first supply line 190.

The shuttle spool 250 may be shifted by a blast of control fluid through either a first shift line 240 or a second shift line 340. The blast of control fluid may be provided at a longitudinal end of the shuttle spool 250, which may displace the shuttle spool 250 in a longitudinal direction, shifting the communication positions of the conduits 280*a*, 280*b*, 280*c* from the first position to the second position. Turning to FIGS. 5A through 5F, the first shift piston 230 may control the delivery of control fluid to the first shift line 240. FIGS. 5A through 5D illustrate close-up views of the first shift piston 230 and first piston chamber 210 in different phases of a pump cycle.

Figure 5A:
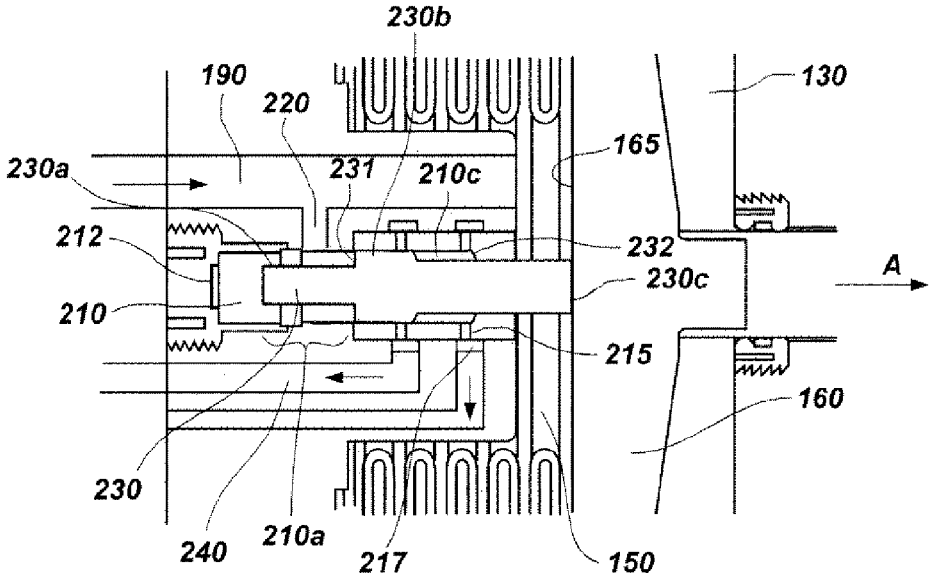
FIGS. 5A-5F show close-up views of a shift mechanism according to the present invention in different phases of a pump cycle.

As previously described, when the first pressure chamber 150 is filled with control fluid, the control fluid may also enter the first piston chamber 210 through a first secondary supply port 220. The control fluid within the first piston chamber 210 may force the first shift piston 230 against a surface 165 of the first flexible member 160. As the control fluid enters the first pressure chamber 150 and the first piston chamber 210, the first shift piston 230 and the first flexible member 160 displace to the right. Referring now to FIG. 5A, a close-up view of the first shift piston 230 midway through a stroke to the right, direction A, the first shift piston 230 includes a shift portion 230*a* having a cross-sectional area less than a cross-sectional area of a central portion 230*b* of the first shift piston 230. The cross-sectional area of the central portion 230*b* may be substantially the same as the cross-sectional area of the inside of the first piston chamber 210, providing a seal between the first piston chamber 210 and the central portion of the first shift piston 230. The cross-sectional area of the shift portion 230*a* of the first shift piston 230 may be less than the cross-sectional area of the inside of the first piston chamber 210, which may provide a shift conduit 210*a* between the inside surface of the first piston chamber 210 and the outside surface of the shift portion 230*a* of the shift piston 230, similar to the conduits created by the shuttle spool 250. The shift conduit 210*a* is in communication with a main chamber 212 of the first piston chamber 210, the main chamber 212 being the portion distal from the first flexible member 160, and always in communication with the first supply line 190, through the first secondary supply port 220.

Figure 5B:
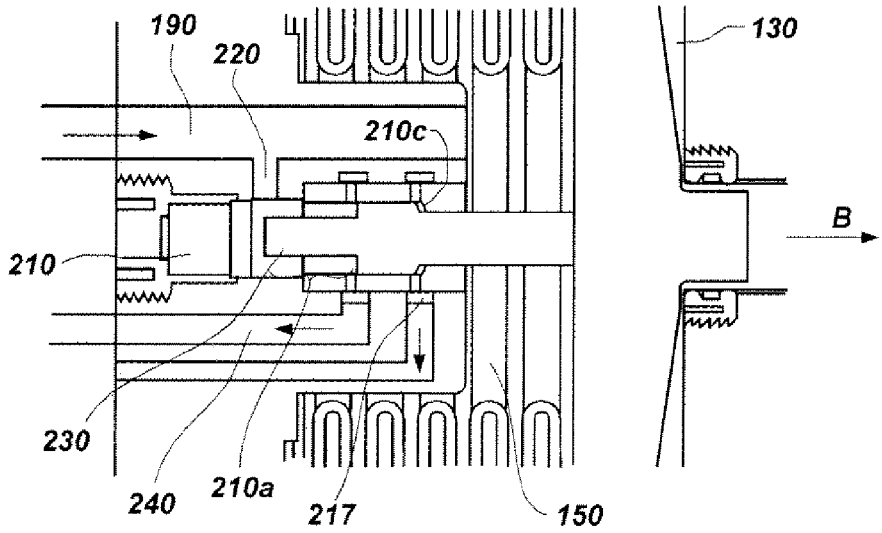

The shift conduit 210*a* may provide access to the first shift line 240 when the first shift piston 230 is displaced to the rightmost position as shown in FIG. 5B (indicated by direction of arrow B), at the end of a stroke, with the first pressure chamber 150 expanded, and the fluid expelled from the first fluid chamber 130. Thus, communication between the first piston chamber 210 and the first shift line 240 is provided at the end of a stroke. The control fluid within the first piston chamber 210 may travel through the first shift line 240 and provide a blast of control fluid within the spool valve 260, shifting the shuttle spool 250 from the first position depicted in FIG. 3 to the second position depicted in FIG. 4. The blast of control fluid may be provided at a longitudinal end of the shuttle spool 250, which may displace the shuttle spool 250 in a longitudinal direction, shifting the communication positions of the conduits 280*a*, 280*b*, 280*c* from the first position (FIGS. 2 and 3) to the second position (FIGS. 1 and 4). Thus, the flow of control fluid is switched from the first supply line 190, filling the first pressure chamber 150, as shown in FIG. 2, to the second supply line 390, filling the second pressure chamber 170, as shown in FIG. 1.

Figure 5E:
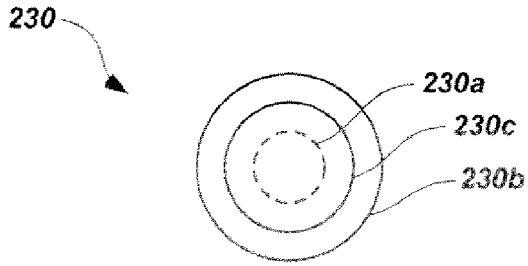

The first shift piston 230 may be configured as an elongated cylinder with the shift portion 230*a* on a first end, the central portion 230*b* with a diameter sufficient to create a seal within the first piston chamber 210, and a vent portion 230*c* on a second end. FIG. 5E depicts a cross-sectional view of the first shift piston 230, taken along line 5E of FIG. 5D. The cross-section of the shift portion 230*a* and the vent portion 230*c* of the first shift piston 230 depicted in FIG. 5E are circular. Thus, the first shift piston 230 comprises three cylindrical sections, arranged longitudinally end-to-end, about the same longitudinal axis, line x-x in FIG. 5D. The shift portion 230*a* may have the smallest diameter, with the vent portion 230*c* having a larger diameter than the shift portion 230*a*, yet a smaller diameter than the central portion 230*b*. A shift portion 230*a* having a diameter larger than the diameter of the vent portion 230*c* is also within the scope of the present invention.

In addition to creating the shift conduit 210*a*, the shift portion 230*a* having a diameter smaller than the diameter of the central portion 230*b* also provides a pushing surface 231 (see FIG. 5A) on the longitudinal end of the central portion 230*b*, surrounding the shift portion 230*a*. The pushing surface 231 may be acted on by the control fluid within the first piston chamber 210. As the control fluid fills the first piston chamber 210, the increased pressure against the pushing surface 231 will force the first shift piston 230 to the right, in the direction of arrow A.

It may be desirable for the shift portion 230*a* to have a diameter smaller than the diameter of the vent portion 230*c*. If the pushing surface 231 has a greater area than an opposing surface 232 on the central portion 230*b*, surrounding the vent portion 230*c*, the force of any control fluid within the first piston chamber 210 on the pushing surface 231 will be greater than the force of the control fluid within the first pressure chamber 150 on the opposing surface 232. Thus, the first shift piston 230 will be forced into the first pressure chamber 150 and against the first flexible member 160 as control fluid fills the first piston chamber 210 and the first pressure chamber 150.

The first shift piston 230 and the first piston chamber 210 may be formed of, for example, ceramic, and the outside diameter of the central portion 230*b* may be just smaller than the inside diameter of the first piston chamber 210. With a tight tolerance, an additional gasket will not be needed to form a seal between the first shift piston central portion 230*b* and the first piston chamber 210. It will be understood that a shift piston including a seal is also within the scope of the present invention. Air, or control fluid, may provide a bearing between the first shift piston 230, the central portion 230*b* and the first piston chamber 210, enabling the first shift piston 230 to reciprocate with minimum friction, and without wearing down either part. Likewise, the vent portion 230*c* of the first shift piston 230 may reciprocate within the portion of the first piston chamber 210 adjacent to the first pressure chamber 150, forming a seal to prevent control fluid from traveling between the vent conduit 210*c* (described hereinbelow) and the first pressure chamber 150. The vent portion 230*c* need not have a circular cross-section, as further described hereinbelow, however the outside perimeter of the vent portion 230*c* may be just smaller than the inside perimeter of the surrounding portion of the first piston chamber 210. Thus, control fluid may provide a bearing therebetween.

Figure 5C:
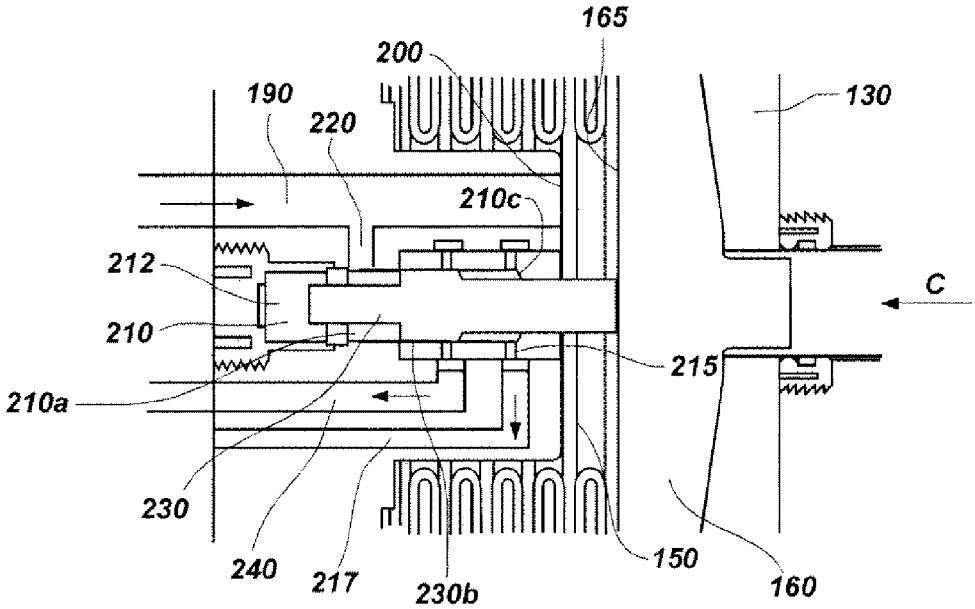
Figure 5D:
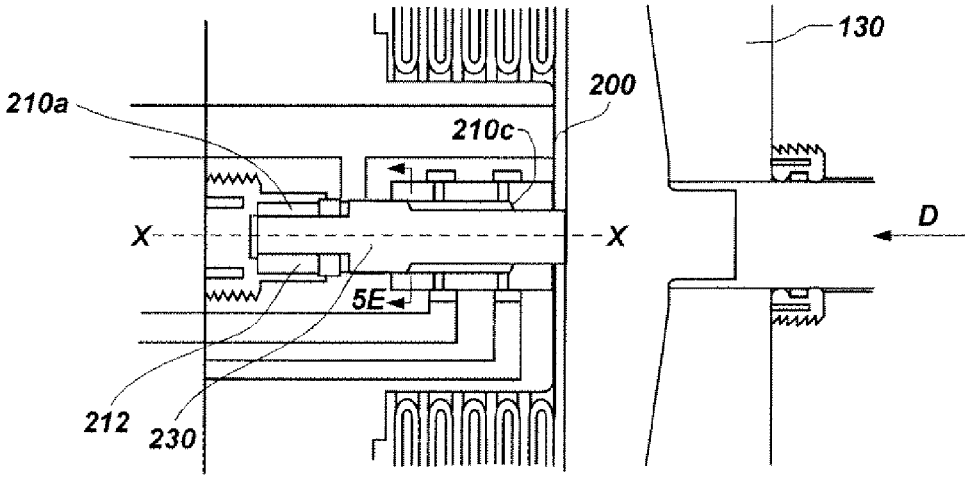
Figure 5F:
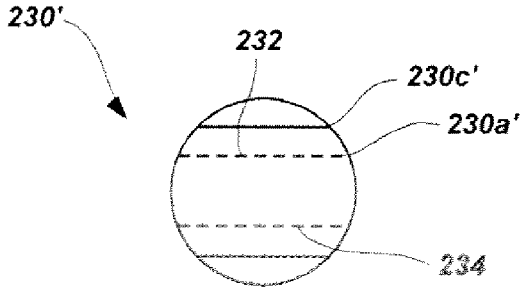

FIG. 5F depicts an alternative embodiment of the shift piston cross-section. In the embodiment depicted in FIG. 5F, the cross-section of the shift portion 230*a*' and the vent portion 230*c*' of the first shift piston 230' are not circular, rather the shift portion 230*a*' and the vent portion 230*c*' with lesser cross-sectional areas are shown as portions of the elongated cylinder having a non-circular cross section. The shift portion 230*a*' may be flattened to form a conduit for control fluid between the first piston chamber 210 and the shift portion 230*a*' of the shift piston 230'. The flattened portion may comprise opposing planar surfaces 232, 234 as shown in FIG.

5F. Opposing arcing portions of the first shift piston 230' may be truncated to form the flattened portions, or opposing planar surfaces 232, 234. Thus the shift conduit 210*a*' may be two parallel conduits within the first piston chamber 210, on opposing sides of the shift portion 230*a*' of the first shift piston 230'. Alternatively, only one arcing portion of the first shift piston 230' may be truncated, with a single shift conduit 210*a*' formed against one planar surface of the shift piston 230'.

It is also within the scope of the present invention for the shift conduit 210*a*' to be formed with a concave or convex surface on the shift portion 230*a*' of the first shift piston 230'. Any shape or volume of the shift portion 230*a* is within the scope of the present invention, provided the first piston chamber 210 is not filled, and a shift conduit 210*a* is formed between the shift portion 230*a* and the first piston chamber 210. In addition, it is within the scope of the present invention for the first piston chamber 210 and the first shift piston 230 to have a cross-section that is not circular, provided the central portion 230*b* of the first shift piston 230 may create a seal with the first piston chamber 210 and the shift portion 230*a* of the first shift piston 230 enables a shift conduit 210*a* between the inside surface of the first piston chamber 210 and the outside surface of the first shift piston 230. The shift piston may be made of one or more of a ceramic, plastic, polymeric materials, composites, metal, and metal alloys, for example.

The second end of the first shift piston 230 may include the vent portion 230*c*. The cross-sectional area of the vent portion 230*c* may be less than the cross-sectional area of the central portion 230*b* and the first piston chamber 210. The vent portion 230*c* may be housed in a distal portion of the first piston chamber 210, proximate to the first flexible member 160. A vent conduit 210*c* is formed between the first piston chamber 210 and the vent portion 230*c* of the first shift piston 230. The vent conduit 210*c* within the first piston chamber 210 may be vented to the exterior of the pump through a vent port 215 and a vent line 217 in a pump housing end cap 60. As the first shift piston 230 displaces toward the right, as shown in FIG. 5A, the central portion 230*b*, or end cap, which has substantially the same cross-section as the interior of the first piston chamber 210, may force air from the vent conduit 210*c* within the first piston chamber 210 through the vent port 215 and the vent line 217. FIG. 5B depicts the first shift piston 230 in a later phase of a rightward stroke, with the shift piston 230 displaced to the right, and the volume of the vent conduit 210*c* of the first piston chamber 210 substantially filled with the central portion 230*b* of the first shift piston 230.

As the pump begins the return stoke, with the shuttle spool 250 in the second position as shown in FIG. 4, control fluid may enter the second pressure chamber 170 and the second piston chamber 310 (see FIG. 1). The second shift piston 330 may be forced to the left by the control fluid in the second piston chamber 310. A vent conduit within the second piston chamber 310 may be vented to the exterior of the pump through a vent port and a vent line 317 in the second end portion 70. As the second shift piston 330 displaces to the left, a central body portion, which has substantially the same diameter as the interior of the second piston chamber 310, may force air from the vent conduit of the second piston chamber 310 through the vent port and the vent line 317. Referring now to the first side of the pump, depicted on the left side in FIG. 1, and in an enlarged view in FIG. 5C, the first shift piston 230 is forced to the left, direction C, by the surface 165 of the first flexible member 160. The vent portion 230*c* of the first shift piston 230 provides the vent conduit 210*c* within the first piston chamber 210 in open communication with the vent port 215 and vent line 217.

FIG. 5C depicts the first shift piston 230 mid-stroke, with the first fluid chamber 130 being filled with fluid and the control fluid within the first pressure chamber 150 being expelled. The first shift piston 230 is traveling to the left, in the direction of arrow C. Air from the exterior of the pump housing may be vacuumed into the vent conduit 210*c* of the first piston chamber 210. Air within the main chamber 212 of the first piston chamber 210 may be expelled through the secondary port 220 to the first supply line 190. As the first flexible member 160 is displaced to the left, air is also expelled to the first supply line 190 from the first pressure chamber 150 through the first primary supply port 200. FIG. 5D depicts the first shift piston 230 displaced to the leftmost position, at the end of a stroke, with the first pressure chamber 150 contracted, and the first fluid chamber 130 filled.

As the first shift piston 230 is displaced to the left, in the direction of arrows C and D in FIGS. 5C and 5D, the first shift conduit 210*a* is also displaced to the left, and communication between the first shift conduit 210*a* and the first shift line 240 is closed. The central portion 230*b* of the first shift piston 230 fills the portion of the first shift conduit 210*a* with access to the first shift line 240, eliminating the flow of control fluid from the main chamber 212 into the first shift line 240. Thus, the first shift piston 230 enables control fluid to pass through the first shift conduit 210*a* and fill the first shift line 240 at the end of each stroke to the right, when the first pressure chamber 150 is filled, then during the return stroke, the flow of the control fluid to the first shift line 240 is cut off by the central portion 230B of the first shift piston 230. Likewise, the second shift piston 330 enables control fluid to pass through a shift conduit in the second piston chamber 310 and fill the second shift line 340 at the end of each stroke to the left, when the second pressure chamber 170 is filled, then during the following stroke, the flow of the control fluid to the second shift line 340 is cut off by the central portion of the second shift piston 330.

The first shift piston 230 is forced against the surface 165 of the first flexible member 160 facing the first pressure chamber 150 by the control fluid within the first piston chamber 210. The first shift piston 230 may abut the surface 165 of the first flexible member 160 without being attached thereto, and be held in place by the pressure of the control fluid within the first piston chamber 210. Alternatively, the first shift piston 230 may be affixed to the first flexible member 160, for example with a threaded connection between the end of the first shift piston 230 and the first flexible member 160. Likewise, the second shift piston 330 may be attached to the second flexible member 180, or may merely abut a surface thereof.

Figure 6:
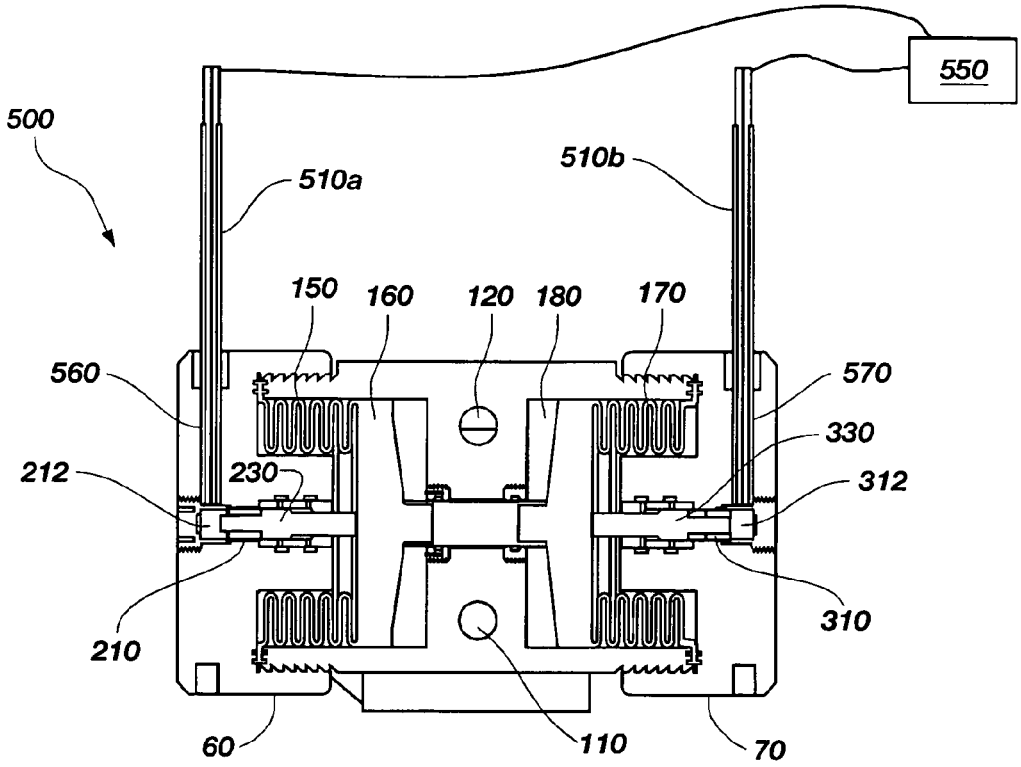
FIG. 6 illustrates an optically controlled reciprocating pump according to the present invention.

In a second embodiment of the present invention, illustrated in FIG. 6, a reciprocating pump 500 may use an electronic shuttle valve or other switching mechanism 550 for switching the flow of control fluid from one pressure chamber to another. The first and second supply lines 190, 390 are not depicted in FIG. 6 for simplicity. A pair of sensors 510*a*, 510*b* may optically detect the end of each stroke. The reciprocating pump 500 may draw fluid in through an input port 110, and discharge fluid through an outlet port 120. The first flexible member 160 and second flexible member 180 may be displaced in a reciprocating fashion, as control fluid fills a first pressure chamber 150 and simultaneously exhausts from a second pressure chamber 170. The first shift piston 230 may travel within the first piston chamber 210, displacing to the right as the first pressure chamber 150 is filled with control fluid, and displacing to the left as the air is exhausted. As the reciprocating pump 500 reaches the end of a stroke, the first shift piston 230 will pass by the first sensor 510*a*. The first sensor 510*a* may comprise a pair of fiber optic sensors disposed through a conduit 560 in the pump housing end cap 60. The conduit 560 in the housing terminates at the main chamber 212 of the first piston chamber 210 and is in optical communication therewith. The sensor 510*a* may detect the presence of the first shift piston 230 within the main chamber 212 of the first piston chamber 210, signifying the end of a stroke. FIG. 5D depicts the first shift piston 230 within the main chamber 212 of the first piston chamber 210. The sensor 510*b* may likewise detect the end of a stroke to the right, with the second shift piston 330 within the main chamber 312 of the second piston chamber 310.

A signal may be transmitted to a controller for a switching mechanism 550, for example an electronically activated shuttle valve, to switch the flow of control fluid from one side of the pump to the other at the end of each stroke. The components of the previously described pneumatically actuated reciprocating pump 100 and the optically actuated reciprocating pump 500 may be identical, with the exception of the conduit 560 in the first pump housing end portion 60 and the conduit 570 in the second pump housing end cap 70 for the optical sensors 510*a*, 510*b*.

Figure 7A:
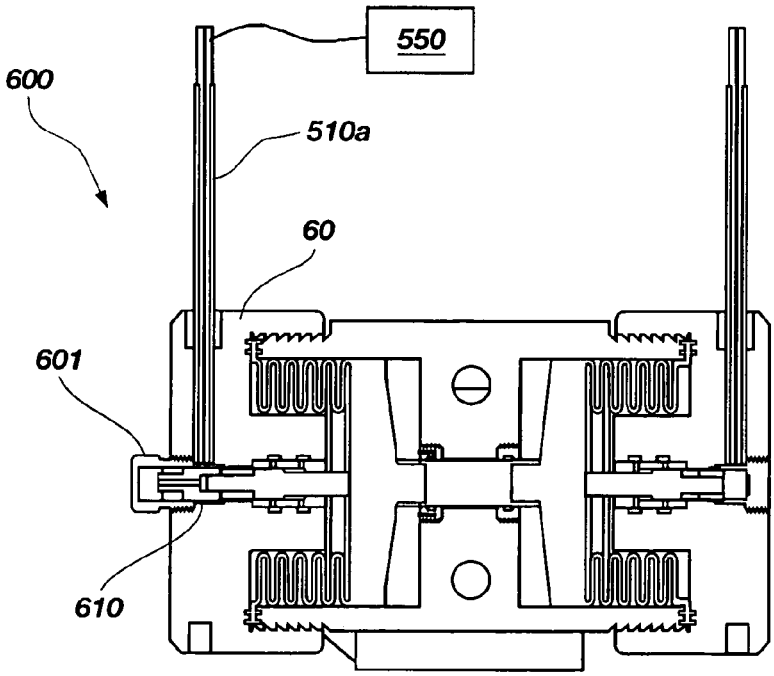
FIG. 7A depicts another optically controlled reciprocating pump according to the present invention.
Figure 7B:
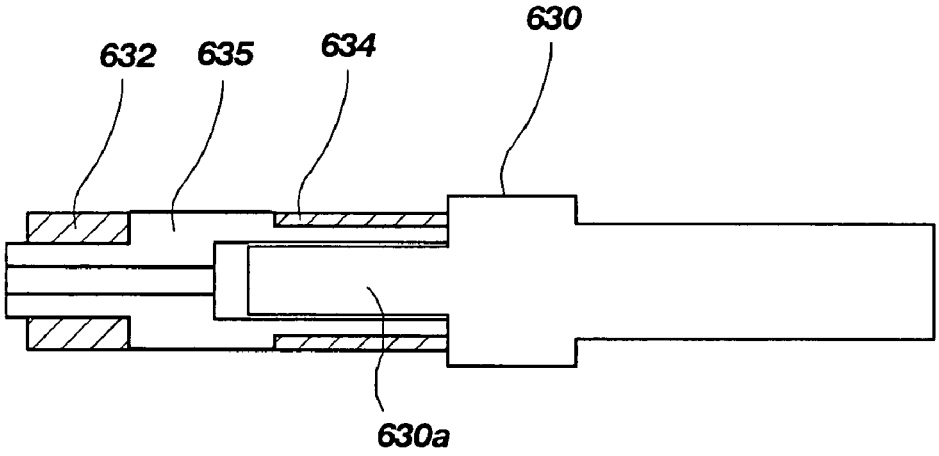
FIG. 7B shows a close-up view of the shift piston of the reciprocating pump of FIG. 7A.

In a third embodiment of the present invention, illustrated in FIGS. 7A and 7B, a reciprocating pump 600 includes a sensor 510*a* on the first side of the pump 600, aligned with the distal portion of the first piston chamber 610. The first shift piston 630, depicted in FIG. 7B includes longitudinally adjacent contrasting color portions 632, 634, 635 around the perimeter of one end thereof. The contrasting color portions 632, 634, 635 may be different shades, detectable by an optical sensor. The first shift piston 630 may comprise an elongated member, and an outside contrasting color portion 632 may comprise a distal end thereof. A central contrasting color portion 635 may be a different shade around the perimeter of the first shift piston 630, adjacent to the central contrasting color portion 635. An inner contrasting color portion 634 may be located adjacent to the central contrasting color portion 635, and is the contrasting color portion farthest from the longitudinal end of the first shift piston 630. Outside contrasting color portion 632 and inner contrasting color portion 634 may be a matching shade, while central contrasting color portion 635 disposed longitudinally therebetween may comprise another shade. The sensor 510*a* may include a pair of fiber optic sensors positioned side-by-side to detect the passage of the first shift piston 630. The outside contrasting color portion 632 passing under the sensor 510*a* may indicate the end of a first stroke of the reciprocating pump 600, such as the position of the first shift piston 230 depicted in FIG. 5D. The inner contrasting color portion 634 passing under the sensor 510*a* may indicate the end of a second stroke of the reciprocating pump 600, such as the position depicted in FIG. 5B. As either the outside or the inner contrasting color portion 632, 634 is sensed, a signal may be transmitted to a controller for a switching mechanism 550, for example an electronically activated shuttle valve, to switch the flow of control fluid from one side of the pump to the other.

The outside and the inner contrasting color portions 632, 634 may comprise, by way of example, black perfluoroalkoxy fluorocarbon resin disposed about the first shift piston 630. The longitudinally adjacent contrasting color portions 632, 634, 635 may be formed integrally with the first shift piston 630, or the longitudinally adjacent contrasting color portions 632, 634, 635 may comprise a cap, which may be an interference fit about the shift portion 630*a* of the first shift piston 630.

Returning to FIG. 7A, a extended cap 601, which may be formed of a translucent material, may be provided to extend the length of the first piston chamber 610. Thus, the length of the first shift piston 630 may be increased to accommodate the longitudinally adjacent contrasting color portions 632, 634, 635, and still have room to reciprocate within the first piston chamber 610. The extended cap 601 may be threaded to removably mate with the housing end portion 60, and may be translucent to enable an optical pathway therethrough for the sensor 510*a*.

Figure 8A:
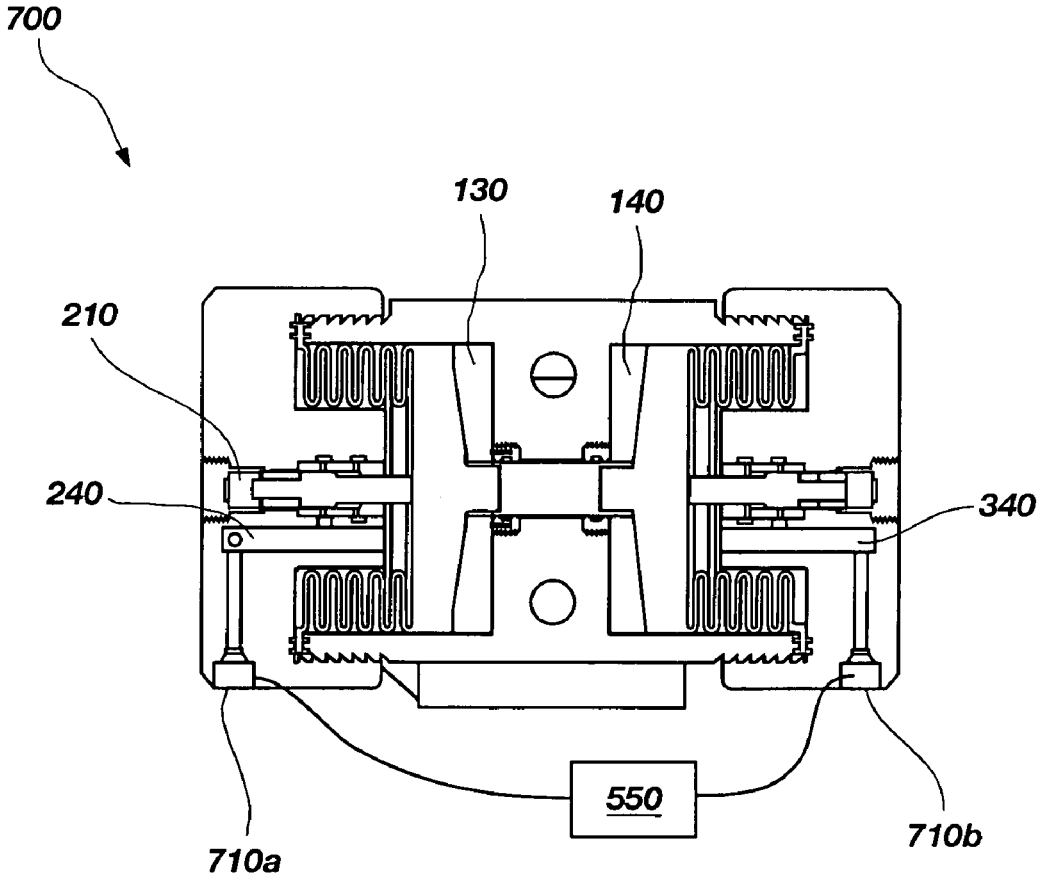
FIG. 8A shows another embodiment of a reciprocating pump according to the present invention.

In a fourth embodiment of the present invention, illustrated in FIG. 8A, a reciprocating pump 700 may have a pressure sensor 710*a*, 710*b* on each side of the pump to detect the end of a stroke and send a signal to an electronic shuttle. A first pressure sensor 710*a* may be mounted at the first shift line 240 to detect an increase in pressure at the end of a rightward stroke when the first shift piston 230 is displaced to the right. FIG. 8A shows a reciprocating pump 700 partially through a stroke; however a close-up view of the first shift piston 230 displaced to the right at the end of a stroke is shown in FIG. 5B. While FIG. 5B depicts a previously described embodiment of the present invention, the reciprocating movement of the shift pistons 230, 330 during each stroke may be replicated in each embodiment. At the end of a stroke expelling fluid from the first fluid chamber 130, the first piston chamber 210 is filled with control fluid, and in communication with the first shift conduit 210*a* and the first shift line 240. The increase in pressure within the first shift line 240 as it fills with control fluid may be detected by the first pressure sensor 710*a*.

A second pressure sensor 710*b* may be mounted at the second shift line 340 for detection of the end of a stroke to the left, expelling fluid from the second fluid chamber 140. As the end of a stroke is detected by either the first or the second pressure sensor 710*a*, 710*b*, a signal may be transmitted to a controller for a switching mechanism 550, for example an electronically activated shuttle valve, to switch the flow of control fluid from one side of the pump to the other.

A pressure sensor 710*a*, 710*b* may comprise, for example a diaphragm having strain gages mounted thereon. A pressure switch, for example a solid-state pressure switch may be useful. The solid-state pressure switch may comprise a polysilicon strain gauge in communication with an ASIC (Application Specific Integrated Circuit) to provide thermal compensated pressure sensing. The sensing results may be used to actuate a solid-state relay or transistor switch such as a piezoelectric transistor. One example of a suitable pressure switch is the DP2-41N digital vacuum and pressure sensor available from SUNX of Kasugai, Japan.

Figure 8B:
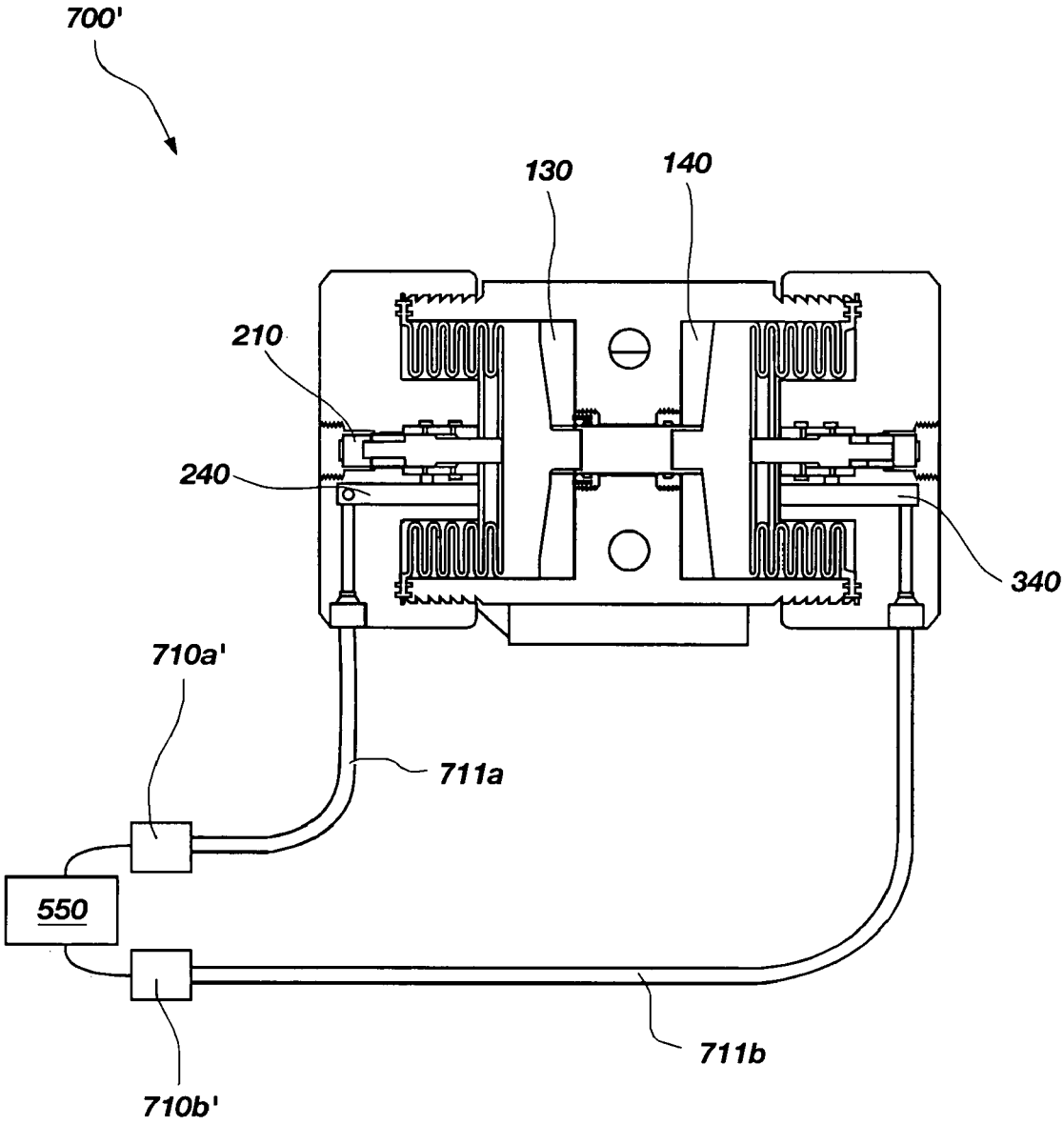
FIG. 8B shows a variation of the reciprocating pump of 8A.

FIG. 8B depicts a variation of the fourth embodiment of the present invention. The reciprocating pump 700' may have pressure sensors 710*a*', 710*b*' located remotely from the pump to detect the end of each stroke and send a signal to an electronic shuttle. Tubing 711*a*, 711*b* may connect the first shift line 240 and the second shift line 340 with the remote pressure sensors 710*a*', 710*b*'. The remote pressure sensors 710*a*', 710*b*' may signal the switching mechanism 550 at the end of each stroke.

Figure 9:
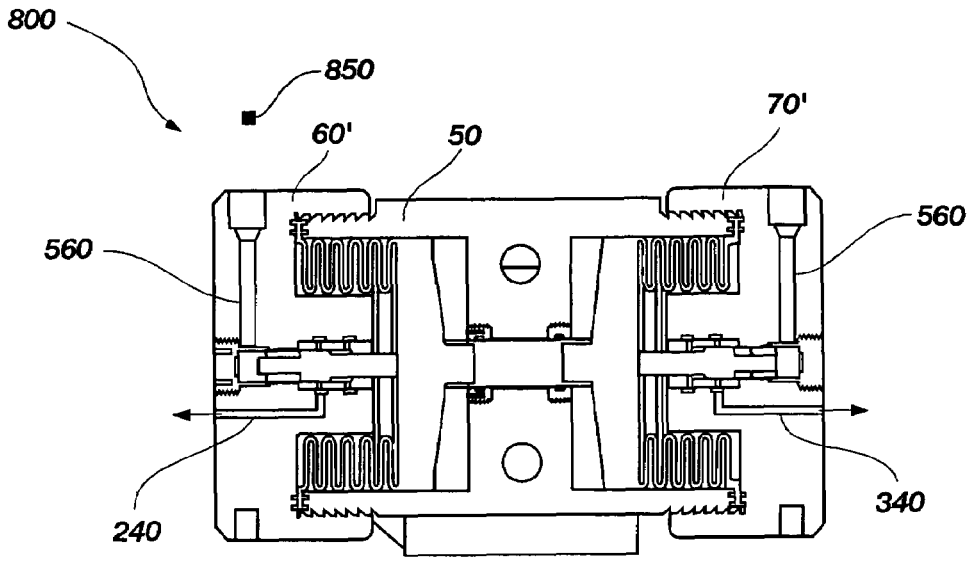
FIG. 9 shows yet another embodiment of a reciprocating pump according to the present invention.

In a fifth embodiment of the present invention, depicted in FIG. 9, a reciprocating pump 800 does not include stroke detection means. Rather, a timer 850 may be used to switch the flow of control fluid from one side of the pump to the other. The timer 850 may send the control fluid to each side for a predetermined length of time. That is, the timer 850 may send the control fluid through the first supply line 190, filling the first pressure chamber 150 until the predetermined time has been reached, then the timer 850 may switch the flow of control fluid to the second supply line 390, filling the second pressure chamber 170. The switching mechanism may be built into the timer 850, or the switching mechanism may be located remotely from the timer 850. The timer 850 may be useful to adjust the stroke length, thereby monitoring the fluid output. For example, by using the timer 850 to shorten the time of each stroke, and thus the stroke cycle, the fluid chambers 130, 140 will not completely fill and empty with each stroke. The fluid output may thus be lessened. Optional conduits 560 in the end caps 60', 70' provide a conduit for optional optical sensors to perform cycle counting for pump monitoring. The pump speed may also be monitored.

In the event that the timer is not properly calibrated to switch the control fluid from one side to the other at the end of a stroke, the reciprocating pump may be vented to bleed the excess control fluid at the end of a stroke. If the excess control fluid is not vented, and for example, the first pressure chamber 150 continues to fill with control fluid at the end of the stroke, the first flexible member 160 may balloon and tear to release the excess control fluid. Referring back to FIG. 1, the portions of the first shift line 240 and the second shift line 340 in communication with the first piston chamber 210 and second piston chamber 310, and passing through the first housing end portion 60 and the second housing end portion 70, respectively, may be included in the reciprocating pump 800 depicted in FIG. 9. The portions of the first shift line 240 and the second shift line 340 through the housing end portions may provide vents at the end of each stroke. Referring to FIG. 5B, at the end of a stroke to the right, if the control fluid continues to enter the pump through the first supply line 190, the excess control fluid may enter the first piston chamber 210 through the first secondary supply port 220. Because it is the end of the stroke, the first shift piston 230 is displaced to the right, and open communication is provided between the first piston chamber 210, the shift conduit 210*a*, and the first shift line 240. The excess control fluid may thus vent through the first shift line 240, which may be open to the outside atmosphere.

Figure 10A:
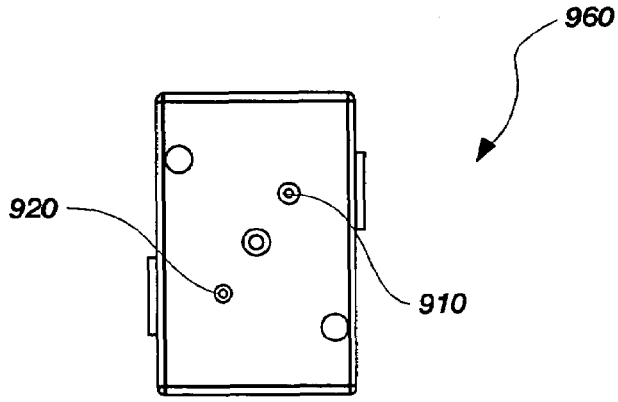
FIG. 10A shows an outside view of the shift valve of FIGS. 3 and 4.
Figure 10B:
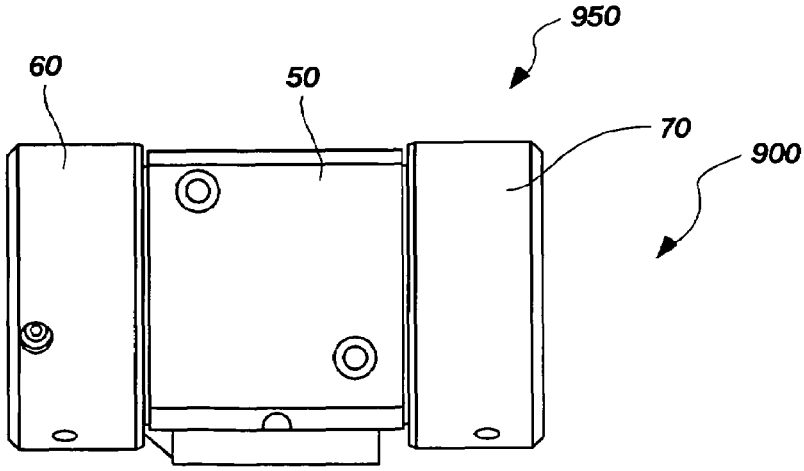
FIG. 10B shows an outside view of a reciprocating pump according to the present invention.

A view of a housing 960 for a switching mechanism, for example a spool valve, is shown in FIG. 10A. A view of a housing 950 for a reciprocating pump 900 of the present invention is shown in FIG. 10B. A first port 910 and a second port 920 within the switching mechanism housing 960 may enable communication with pressure sensors 710*a*' and 710*b*', as shown in FIG. 8B. The housing 960 may enable the switching mechanism to be located remotely from the body of the reciprocating pump 900.

Turning to FIG. 10B, the housing 950 may include a central portion 50 housing the first fluid chamber 130 and the second fluid chamber 140. A first housing end portion 60 may include the first piston chamber 210 therein, and may be threaded to removably attach to the central housing portion 50. A second housing end portion 70 may include the second piston chamber 310 therein, and may be threaded to removably attach to the central housing portion 50. Other methods of attaching the first and second housing end portions 60, 70 and the central housing portion 50 are within the scope of the present invention. For example, the housing portions 50, 60, 70 may be permanently attached with resin or epoxy, a weld, or the housing portions may have tight tolerances, and be friction fitted together.

The central housing portion 50 may be generally cylindrical, and may be formed from plastic, polymeric materials, composites, metal, and metal alloys for example. The central housing portion 50 may be annular, forming the first fluid chamber 130 and the second fluid chamber 140 therein. The first end portion 60 may include the first piston chamber 210 therein, and include a threaded inner circumference 62 to engage with threads 52 on the circumference of the pump housing central portion 50 (see FIG. 2). A second end portion 70 may include the second piston chamber 310 therein, and include a threaded inner circumference to engage with threads on the circumference of the pump housing central portion 50.

Figure 11:
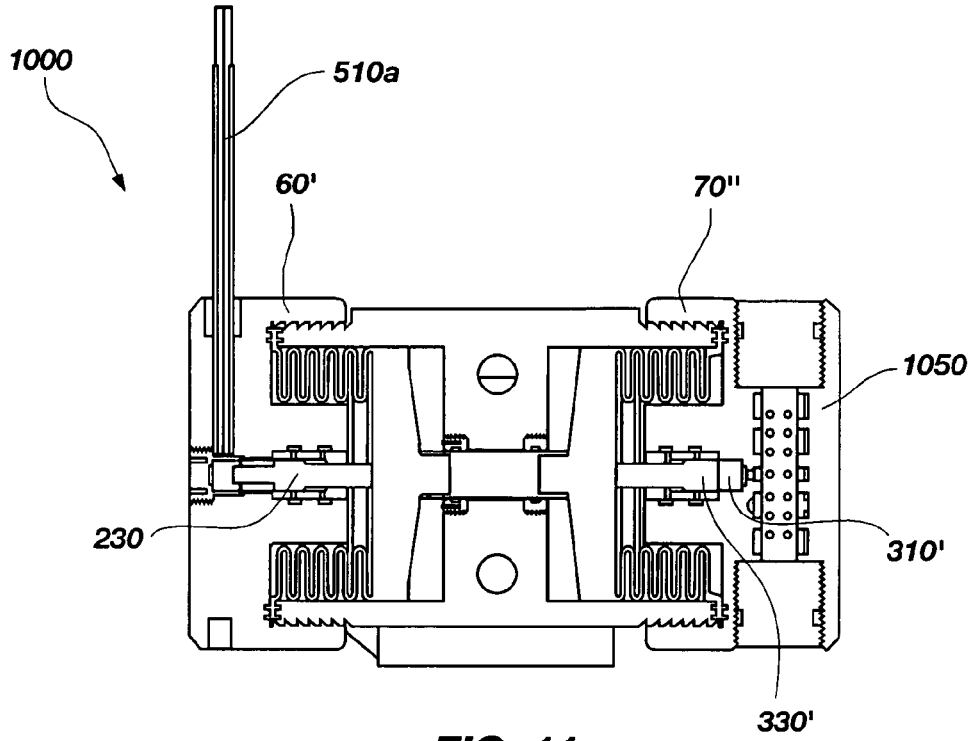

A seventh embodiment of the present invention is depicted in FIG. 11. A reciprocating pump 1000 includes a spool valve 1050 housed within a second end cap 70" of the reciprocating pump 1000. Conduits (not shown) within the housing of the pump may provide passage for the control fluid supply lines 190, 390, which are depicted outside the pump housing 50 in FIGS. 1 and 2. Including the spool valve 1050 within the pump housing, specifically within an end cap of the housing, enables the length of the fluid supply lines to be minimized, and the reciprocating pump may be transported more efficiently. FIG. 11 depicts a pump configured for the use of an optical sensor 510*a*, however a reciprocating pump having any actuating mechanism for the spool valve 1050 housed within the primary pump housing is within the scope of the present invention. For example, the pump may be shifted pneumatically, and the reciprocating pump 1000 may not include an optical sensor 510*a*. In yet another example, the pump may be shifted pneumatically and the optical sensor may be useful for purposes such as pump monitoring.

FIG. 11 depicts an optional truncated second shift piston 330'. The truncated second shift piston 330' does not include a shift portion. Referring back to FIG. 5A, the shift portion 230*a* is the portion of the first shift piston 230 extending into the main chamber 212 of the first piston chamber 210. Turning back to FIG. 11, the stroke detection means for the reciprocating pump 1000 is the optical sensor 510*a*, which detects the position of the first shift piston 230. The second shift piston 330' does not require a shift portion, as the position thereof is not being detected. The second piston chamber 310' may thus be shorter than the second piston chamber 310 of the reciprocating pump 100 shown in FIG. 1. This may provide additional space within the second end cap 70" for the spool valve 1050. It will be understood by one skilled in the art that a truncated piston may be useful as both the first and the second shift piston in a reciprocating pump having pneumatic actuating means, as depicted in FIGS. 1 and 2, as well as reciprocating pumps having pressure sensors for stroke detection, as depicted in FIGS. 8A and 8B, and reciprocating pumps having a timer, as depicted in FIG. 9. Use of a truncated piston may be useful to enable use of a shorter end cap, and thus the length of the entire pump may be shortened.

Figure 12:
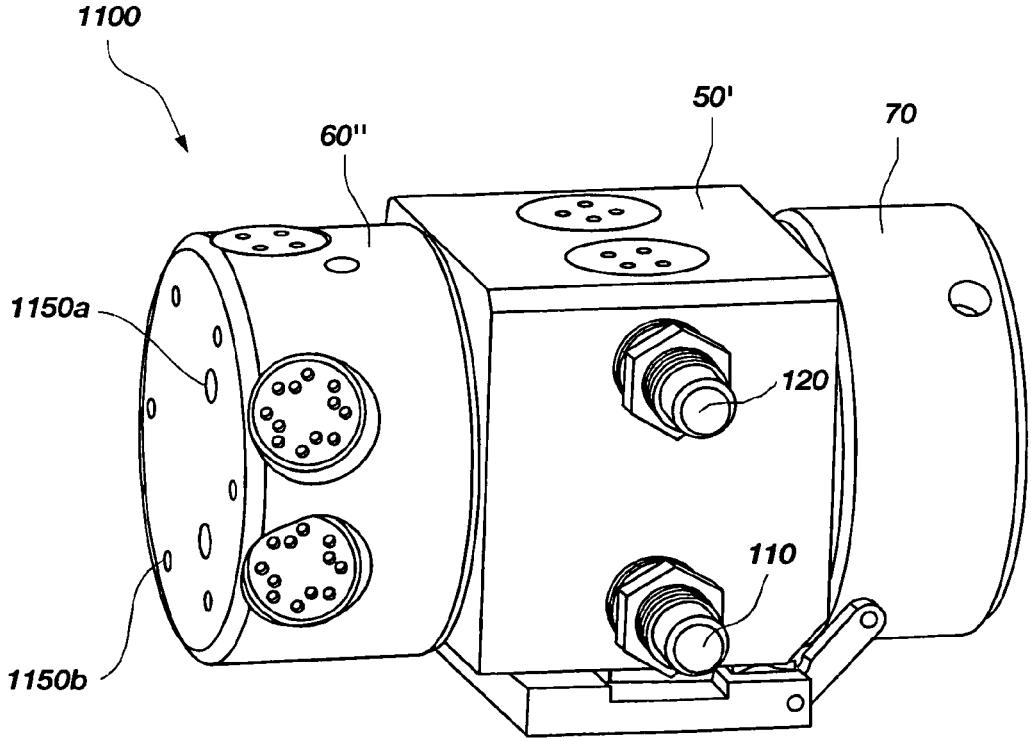
FIG. 12 shows an outside view of a reciprocating pump according to the present invention.

In an eighth embodiment of the present invention, depicted in FIG. 12, a reciprocating pump 1100 including a spool valve 1050 in the head of the reciprocating pump 1000 is configured for the use of pressure switches for detection of the end of a stroke. Ports 1150*a*, 1150*b* in the end cap 60" enable connection with the pressure switches. The pressure switches may be useful for pump monitoring, and one or two pressure switches may be used. A pressure switch on only one side of the pump may be sufficient for pump monitoring. Monitoring of the reciprocating pump 1000 may be useful, as the pump running faster or slower may be indicative of problems. For example, the pump may run faster if there is a hole in the bellows, or slow down if a filter backs up. The fluid inlet port 110 and the fluid outlet port 120 through the pump housing central portion 50' are shown. The pump housing central portion 50' is depicted with a rectangular cross-section; however, a cross-section of any geometrical configuration is within the scope of the present invention.

Figure 13:
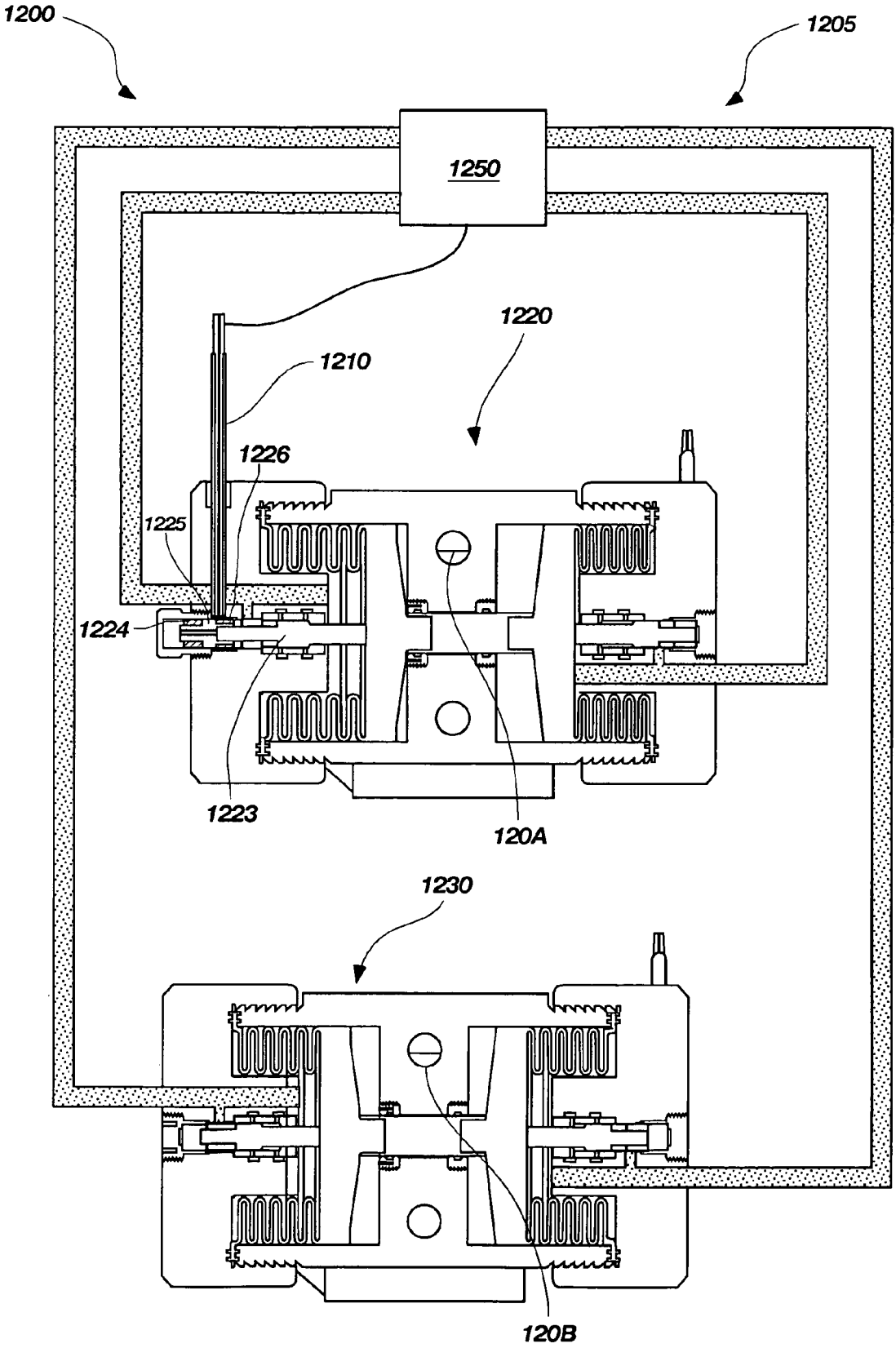
FIG. 13 shows a system of multiple reciprocating pumps of the present invention.

FIG. 13 illustrates a system 1200 of multiple reciprocating pumps having a shifting system 1205 controlled by the movement of one control pump 1220 of the multiple reciprocating pumps. The system 1200 of multiple reciprocating pumps is integrated with staggered cycles, enabling reduced fluid surge in the system. When the control pump 1220 is at the end of a stroke as shown, a second pump 1230 may be at the pumping/exhaust cycle point in the cycle. At the end of the stroke, the control pump 1220 is not expelling fluid from the outlet port 120A. At this time, the second pump 1230 is mid-stroke, and is expelling fluid from the outlet port 120B.

The control pump 1220 includes an optical sensor 1210 in communication with a shifting mechanism 1250 of the shifting system 1205, and a first shift piston 1223 including at least three shaded bands 1224, 1225, 1226. When the optical sensor 1210 detects the first shaded band 1224, the shifting system 1205 may switch the control fluid for the control pump 1220 from a first side to a second side. This may momentarily pause the flow from the control pump outlet port 120A; however the second pump 1230 will be mid-stroke, and steady flow from the second pump outlet port 120B will be maintained. When the second shaded band 1225 is detected, the control fluid for the second pump 1230 may be switched from a first side to a second side. This may momentarily pause the flow from the second pump outlet port 120B; however the control pump 1220 will be mid-stroke, and steady flow from the control pump outlet port 120A will be maintained. When the third shaded band 1226 is detected, the control fluid for the control pump 1220 may be switched from a second side to a first side, and the shift piston 1223 will change directions. Steady flow from the second pump outlet port 120B will cover the pause from the control pump outlet port 120A. When the second shaded band 1225 is detected again, the control fluid for the second pump 1230 may be switched from the second side to the first side, and so on. Thus a more constant and uniform fluid flow from the multiple reciprocating pumps is enabled. It will be understood that a system of more than two reciprocating pumps with staggered cycles is within the scope of the present invention, with an additional shaded band added to the shift piston 1223 for each additional reciprocating pump.

Although specific embodiments have been shown by way of example in the drawings and have been described in detail herein, the invention may be susceptible to various modifications, combinations, and alternative forms. Therefore, it should be understood that the invention is not intended to be limited to the particular forms disclosed. Rather, the invention includes all modifications, equivalents, combinations, and alternatives falling within the spirit and scope of the invention as defined by the following appended claims.

What is claimed is:

1. A reciprocating pump, comprising:

a first pressure chamber at least partially defined by a first flexible member;

a second pressure chamber opposing the first pressure chamber and at least partially defined by a second flexible member;

a shaft member extending between the first flexible member and the second flexible member;

a first shift piston positioned proximate to the first flexible member on a side thereof opposite the shaft member, wherein the first shift piston comprises an elongated member including a first end portion having a first cross-sectional area and a substantially central portion having a second cross-sectional area greater than the first cross-sectional area; and a second shift piston positioned proximate to the second flexible member on a side thereof opposite the shaft member, wherein the second shift piston comprises an elongated member including a first end portion having a first cross-sectional area and a substantially central portion having a second cross-sectional area greater than the first cross-sectional area.

2. The reciprocating pump of claim 1, wherein the first shift piston and the second shift piston are positioned at least substantially along a common axis with the shaft member.

3. The reciprocating pump of claim 1, wherein the shaft member is attached to each of the first flexible member and the second flexible member.

4. The reciprocating pump of claim 1, wherein the first pressure chamber is configured to receive a control fluid therein.

5. The reciprocating pump of claim 4, wherein a supply of control fluid is shiftable from the first pressure chamber to the second pressure chamber using a spool valve.

6. The reciprocating pump of claim 5, wherein the spool valve is pneumatically shiftable.

7. The reciprocating pump of claim 6, wherein the first shift piston is housed within a first piston chamber, and the first shift piston is operable between a first position, wherein a first shift line may be in communication with the spool valve and the first piston chamber, and a second position, wherein the first shift line is not in communication with the first piston chamber.

8. The reciprocating pump of claim 7, wherein the central portion of the first shift piston is positioned adjacent a port between the first piston chamber and the first shift line with the first shift piston in the first position.

9. The reciprocating pump of claim 7, wherein the central portion of the first shift piston is positioned between the first piston chamber and the first shift line with the first shift piston in the second position.

10. The reciprocating pump of claim 5, wherein the spool valve is electronically shifted.

11. The reciprocating pump of claim 10, wherein electronic shifting of the spool valve is actuatably responsive to a signal from an optical sensor.

12. The reciprocating pump of claim 11, wherein the first shift piston includes a first portion bordered with contrasting color portions.

13. The reciprocating pump of claim 10, wherein the electronic shifting of the spool valve is actuatably responsive to a signal from using a pressure sensor.

14. The reciprocating pump of claim 10, wherein the electronic shifting is actuatably responsive to a timer.

15. The reciprocating pump of claim 1, wherein the first shift piston is configured to drive the first flexible member, and wherein the second shift piston is configured to drive the second flexible member.

16. A method of driving a reciprocating pump, comprising:

providing a housing having a first pressure chamber and a second pressure chamber disposed therein, wherein the first pressure chamber is at least partially defined by a first flexible member and the second pressure chamber is at least partially defined by a second flexible member;

filling the first pressure chamber with a control fluid and increasing a volume of the first pressure chamber;

filling a first piston chamber with the control fluid and pressing a first shift piston at least partially housed within the first piston chamber against the first flexible member;

displacing the first shift piston to create a shift conduit between an outside surface of the first shift piston and an inside surface of the first piston chamber;

filling a first shift line in communication with the shift conduit and the first piston chamber with the control fluid; and displacing the first shift piston and eliminating communication between the first piston chamber and the first shift line.

17. The method of claim 16, wherein displacing the first shift piston comprises displacing the first shift piston toward the first flexible member, and simultaneously displacing at least a portion of the first flexible member.

18. The method of claim 16, further comprising expelling control fluid from the second pressure chamber while simultaneously filling the first pressure chamber with the control fluid.

19. The method of claim 16, further comprising shifting a shuttle valve with the control fluid from the first shift line, to switch flow of control fluid from the first pressure chamber to the second pressure chamber.

20. The method of claim 16, further comprising signaling a pressure switch in communication with the first shift line when the first shift line fills with control fluid.

21. The method of claim 20, further comprising controlling flow of control fluid between the first pressure chamber and the second pressure chamber with the pressure switch.

22. The method of claim 16, further comprising optically sensing a displacement of the first shift piston with an optical sensor.

23. The method of claim 22, further comprising controlling flow of control fluid between the first pressure chamber and the second pressure chamber with a control switch in communication with the optical sensor.

24. A reciprocating pump, comprising:

a body defining a first fluid chamber and a first pressure chamber separated with a first flexible member and a second fluid chamber and a second pressure chamber separated with a second flexible member;

a shaft connecting the first flexible member and the second flexible member;

a switching mechanism for alternately supplying control fluid to the first pressure chamber and the second pressure chamber, the first flexible member and the second flexible member being displaceable with the supplied control fluid;

a first shift piston configured for displacement with the first flexible member and driveable by the supplied control fluid, wherein the first shift piston comprises an elongated member including a first end portion having a first cross-sectional area and a central portion having a second cross-sectional area greater than the first cross-sectional area;

a second shift piston configured for displacement with the second flexible member and driveable by the supplied control fluid, wherein the second shift piston comprises an elongated member including a first end portion having a first cross-sectional area and a central portion having a second cross-sectional area greater than the first cross-sectional area;

a first shift line in communication with the supplied control fluid when the first end portion of the first shift piston is adjacent thereto and isolated from the supplied control fluid when the central portion of the first shift piston is adjacent thereto; and a second shift line in communication with the supplied control fluid when the first end portion of the second shift piston is adjacent thereto and isolated from the supplied control fluid when the central portion of the second shift piston is adjacent thereto.

25. The reciprocating pump of claim 24, wherein the switching mechanism is actuatable by the supplied control fluid in the first shift line and the second shift line.

26. The reciprocating pump of claim 24, wherein the switching mechanism is actuatable by a pressure sensor configured to detect the supplied control fluid in the first shift line and the second shift line.

27. The reciprocating pump of claim 24, wherein the switching mechanism is actuatable by an optical sensor configured to detect a first position and a second position of the first shift piston.

28. The reciprocating pump of claim 24, wherein the switching mechanism is actuatable by an optical sensor configured to detect a first position of the first shift piston and a first position of the second shift piston.

29. The reciprocating pump of claim 24, wherein the switching mechanism is actuatable by a timer.

30. A system of reciprocating pumps, comprising:

a control pump having a reciprocating shift piston with at least three bands of contrasting colors;

an optical sensor configured to detect at least a first position, a second position, and a third position of the reciprocating shift piston;

a shifting system in communication with the optical sensor, the shifting system configured to shift the supply of a control fluid from a first side of the control pump to a second side of the control pump; and a second pump controllable by the shifting system, the control fluid being alternately supplied to a first side of the second pump and a second side of the second pump from the shifting system.

31. The system of claim 30, wherein an outside band of the at least three bands and an inside band of the at least three bands comprise a matching shade.

* * * * *

UNITED STATES PATENT AND TRADEMARK OFFICE

CERTIFICATE OF CORRECTION

PATENT NO. : 7,458,309 B2
APPLICATION NO. : 11/437447
DATED : December 2, 2008
INVENTOR(S) : Tom M. Simmons, John M. Simmons and David M . Simmons It is certified that error appears in the above-identified patent and that said Letters Patent is hereby corrected as shown below:

On the title page:

In ITEM (56) Reference Cited

U.S. PATENT DOCUMENTS

Page 2, 1st column, 1st line of the 9th entry (line 11), change "12/1992 Korver" to --10/1992 Korver--

Signed and Sealed this
Fifth Day of February, 2013

Teresa Stanek Rea
*Acting Director of the United States Patent and Trademark Office*